US011148410B2

(12) United States Patent
Brownlow et al.

(10) Patent No.: US 11,148,410 B2
(45) Date of Patent: Oct. 19, 2021

(54) APPARATUS AND METHOD FOR PRINTING ON CURVED SURFACES

(71) Applicant: Clarion Technologies, Inc., Holland, MI (US)

(72) Inventors: John Brownlow, Ada, MI (US); Robert Bronsink, Rockford, MI (US); Roland R. Dubay, Holyoke, MA (US); Joseph J. Gilberti, Avon, CT (US)

(73) Assignee: Clarion Technologies, Inc., Holland, MI (US)

( * ) Notice: Subject to any disclaimer, the term of this patent is extended or adjusted under 35 U.S.C. 154(b) by 643 days.

(21) Appl. No.: 15/684,329

(22) Filed: Aug. 23, 2017

(65) Prior Publication Data

US 2018/0056643 A1 Mar. 1, 2018

Related U.S. Application Data

(60) Provisional application No. 62/378,262, filed on Aug. 23, 2016.

(51) Int. Cl.

| | |
|---|---|
| ***B41F 15/44*** | (2006.01) |
| ***B41F 15/08*** | (2006.01) |
| ***B44F 1/06*** | (2006.01) |

(52) U.S. Cl.

CPC ..... *B41F 15/44* (2013.01); *B41F 15/0895* (2013.01); *B44F 1/06* (2013.01)

(58) Field of Classification Search

CPC ..... B41F 15/44; B41F 15/0895; B44F 1/06
See application file for complete search history.

(56) References Cited

U.S. PATENT DOCUMENTS 4,909,145 A * 3/1990 Ericsson ..... B41F 15/0818 101/123
5,787,805 A * 8/1998 Szyszko ..... B41F 15/10 101/123

(Continued)

FOREIGN PATENT DOCUMENTS

EP 0730954 * 11/1996 ..... B41F 15/42
JP 02-310988 * 12/1990 ..... H05K 3/12

(Continued)

OTHER PUBLICATIONS

English translation of EP 0730954, publication date Nov. 1996. (Year: 1996).*

*Primary Examiner* — Matthew G Marini
*Assistant Examiner* — Marissa Ferguson-Samreth
(74) *Attorney, Agent, or Firm* — Gardner, Linn, Burkhart & Ondersma LLP

(57) ABSTRACT

A method and apparatus for screen printing facilitate the application of colors, patterns, and other indicia onto a curved printing substrate, such as a concave glass surface of an appliance. The apparatus includes a print head assembly that is typically supported by a frame and is movable relative to the frame and the printing substrate. The print head assembly includes biasing elements with movable end portions that support a wiper and apply varying levels of pressure to the wiper as it is moved along the curved surface or surfaces of the substrate during a printing process. The print head assembly and associated screen printing equipment may be automated or computer controlled so as to independently vary the pressure of the biasing elements and, thus, the pressure of different areas of the wiper along the substrate, to accommodate simple or complex curves in the substrate surface.

20 Claims, 16 Drawing Sheets

(56) References Cited

U.S. PATENT DOCUMENTS

| | | | | |
|---|---|---|---|---|
| 6,698,345 | B2 * | 3/2004 | Cutcher | B41F 15/0895 101/123 |
| 7,182,019 | B2 * | 2/2007 | Cutcher | B41F 15/0895 101/123 |
| 9,505,205 | B2 * | 11/2016 | Willshere | B41F 15/423 |
| 2013/0139710 | A1 * | 6/2013 | Goetz | B41F 15/44 101/114 |
| 2015/0351295 | A1 * | 12/2015 | Itoh | H05K 13/0465 228/102 |

FOREIGN PATENT DOCUMENTS

| | | | | |
|---|---|---|---|---|
| JP | 04044848 | * | 2/1992 | B41F 15/08 |
| JP | 10-95099 | * | 4/1998 | B41F 15/36 |

* cited by examiner

APPARATUS AND METHOD FOR PRINTING ON CURVED SURFACES

CROSS REFERENCE TO RELATED APPLICATION

The present application claims the benefit of U.S. provisional application Ser. No. 62/378,262, filed Aug. 23, 2016, which is hereby incorporated herein by reference in its entirety.

FIELD OF THE INVENTION

The present invention relates to systems and methods for screen printing colors, patterns, designs, and indicia onto surfaces.

BACKGROUND OF THE INVENTION

Screening printing methods and systems can be used for applying colors, patterns, and designs including lettering onto other surfaces, including non-porous surfaces such smooth glass. For example, labels may be screen printed onto the convex outer surfaces of cylindrical bodies of glass beverage bottles, by rotating the bottles about their longitudinal axes as a stationary print head applies the label to the moving surface. However, smooth glass control panels are now being developed for use with appliances such as stoves, ovens, microwave ovens, dishwashers, refrigerators, washing machines, laundry dryers, and the like, such as using capacitive touch technology. It is often desirable to have indicia visible along these surfaces, which surfaces are non-cylindrical, such as to indicate the locations of control sensors, while optionally leaving translucent areas where lights or lighted displays are positioned.

Because of the size of such panels, some of which may be integral with another panel or surface of the appliance (e.g., a control panel at the front of the glass cooktop surface of a stove), and because the panels may have curved regions (including concave or convex surfaces) that are desired for printing, traditional print screening methods have not been suited for such applications. For example, using traditional print screening methods on curved surfaces, and particularly concave surfaces, may result in uneven screen tension and unacceptable results.

It is known to apply a flexible film with printed indicia to the back or underside of a glass panel, using adhesive, and optionally applying another layer of glass or polymer film to sandwich the printed flexible film between the two glass panels. However, this may result in a finished panel that is thicker than desired, which increases its weight and may decrease the performance of capacitive touch controls or the like. Moreover, a multi-layered panel may also be susceptible to delamination, which results in unacceptable changes in appearance and may result in ultimate failure of the panel and/or associated electronics. In addition, there are often three or four components used to create a finished panel in a multi-step process using traditional methods, which results in longer manufacturing times and higher cost that makes it prohibitive to use such panels in low to moderate priced appliances.

SUMMARY OF THE INVENTION

The present invention provides a method and apparatus for screen printing, which is particularly well-suited for applying inks of various desired colors, patterns, or other indicia onto a curved printing substrate, such as curved glass used for a capacitive-touch controller associated with a household appliance. A print head assembly is movable relative to the printing substrate, which may be held in a fixture during a printing process. The print head assembly includes biasing elements with movable portions that support a wiper, such as a flexible squeegee, while applying varying levels of pressure to the wiper as it is moved along one or more curved surface regions of the substrate. Optionally, the print head assembly and associated screen printing equipment (e.g., a substrate fixture, a screen fixture, a linear actuator for the print head assembly) are automated or computer controlled, such as via a stepper motor or servo motor controller, so that the pressure applied by each biasing element is done independently for a given printing process and substrate, so that the apparatus can be programmed for screen printing onto different substrates having different dimensions and/or curvatures, different print patterns, inks, and the like.

According to one form of the present invention, a screen printing apparatus includes a support frame, a substrate fixture coupled to the support frame, and a print head assembly including first and second actuatable biasing elements and an elongate wiper. The substrate fixture is configured for holding a printing substrate having a printable surface with a non-planar region. The print head assembly is supported at the support frame and is spaced from the substrate fixture. The first and second actuatable biasing elements of the print head assembly have respective distal end portions spaced apart from one another, and the elongate wiper is coupled to the distal end portions of the actuatable biasing elements. The wiper has first and second end portions opposite one another, and the distal end portion of the first biasing element is coupled to the wiper at the first end portion of the wiper, while the distal end portion of the second biasing element is coupled to the wiper at the second end portion of the wiper. The first and second actuatable biasing elements are operable to apply varying forces to the wiper in the direction of the substrate fixture as the print head assembly and the substrate fixture are moved relative to one another, with the wiper moving along the non-planar region of the printing substrate during a printing operation.

In one aspect, the first and second actuatable biasing elements are independently operable to apply different and varying forces to respective regions of the wiper during the printing operation.

In another aspect, the actuatable biasing elements are pneumatic or hydraulic piston actuators.

In a further aspect, a screen and screen support frame are provided, with the screen disposed between the wiper and the substrate fixture. The screen support frame is pivotable relative to the wiper and the substrate fixture during the printing operation.

In still another aspect, a programmable computer processor is operable to access and execute a computer program containing instructions for an actuation sequence. The processor is operable to actuate, in a programmed sequence, one or more of (i) the biasing elements, (ii) a lifting actuator coupled to the substrate fixture, (iii) a linear actuator that drives the print head assembly, (iv) an ink emitter coupled to the print head assembly, and (v) a pivot actuator coupled to the screen support frame.

In another form of the present invention, a screen printing head assembly includes a carriage, first and second actuatable biasing elements, and an elongate wiper attached to the biasing elements. The carriage is movable relative to a substrate fixture and a printing substrate mounted to the substrate fixture. The actuatable biasing elements having respective proximal end portions coupled to the carriage, and respective movable distal end portions spaced apart from one another and extending away from the carriage, with the elongate wiper coupled to the distal end portions of the actuatable biasing elements. The wiper has first and second end portions disposed opposite one another, with the distal end portion of the first biasing element coupled to the wiper at its first end portion and the distal end portion of the second biasing element is coupled to the wiper at its second end portion thereof. The first and second actuatable biasing elements are operable to apply varying forces to the wiper as the printing head assembly is moved relative to the substrate fixture with the wiper moving along a non-planar region of the printing substrate during a printing operation.

In still another form of the present invention, a method is provided for printing a substrate having a printable surface with a non-planar region. The method includes positioning the substrate at a substrate fixture, moving a print head assembly relative to the substrate fixture and the substrate, applying varying forces to different portions of an elongate wiper, and directing a flowable ink onto the non-planar region of the printing substrate. The print head assembly includes (i) first and second actuatable biasing elements having respective distal end portions spaced apart from one another, and (ii) the elongate wiper having a first end portion coupled to the distal end portion of the first actuatable biasing element, and a second end portion coupled to the distal end portion of the second actuatable biasing element. During movement of the print head assembly, the wiper moves along the non-planar region of the printing substrate and a spacing between the printing substrate and a portion of the print head assembly varies as the print head assembly moves in a first direction relative to the substrate. The varying forces are applied to the first and second end portions of the wiper via the first and second actuatable biasing elements as the wiper moves along the non-planar region of the printing substrate.

Thus, the screen printing apparatus and method of the present invention allows for colors, patterns, indicia, and the like to be printed on curved or undulating surfaces, including surfaces with combinations of planar portions, curved portions, and surfaces having different curvatures in different regions thereof. This is accomplished using a print head assembly with actuators or biasing elements that support a wiper and are capable of applying different forces to different regions of the wiper in the direction of a printing substrate, such as a glass panel, as the print head is moved relative to the printing substrate.

These and other objects, advantages, purposes and features of the present invention will become apparent upon review of the following specification in conjunction with the drawings.

DESCRIPTION OF THE PREFERRED EMBODIMENTS

Figure 1:
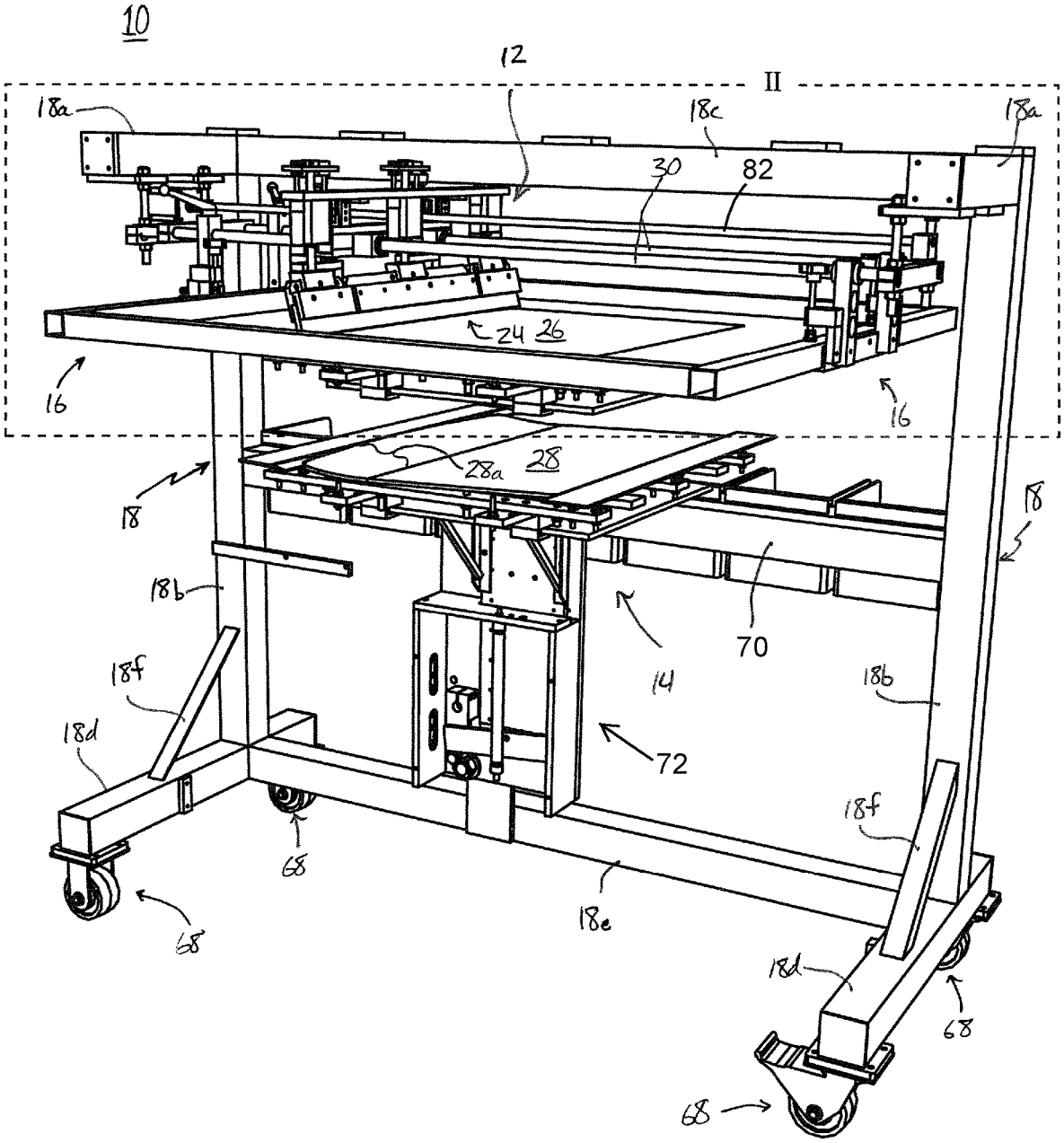
FIG. 1 is a perspective view of a printing apparatus in accordance with the present invention, shown supporting a glass panel in a lowered loading position.

A screen printing apparatus and method are provided to facilitate the application of inks to curved surfaces via screen printing methods. This is accomplished by varying the pressure applied to a wiper, which may include a flexible squeegee element, as it is drawn across a curved substrate surface during a screen printing operation. The wiper pressure can be varied along the travel path of an associated print head assembly in a screen printing operation, which can also permit one or more wiper holders (which may be independently actuatable) to move relative to a carriage or other support to which the holders are mounted. In addition to achieving quality printing results on curved surfaces, the apparatus and method may be conducted on tempered glass, resulting in a stronger finished product than if screen printing were conducted on non-tempered glass with ceramic frit that is subsequently put through tempering. Compared to the use of multi-layer glass and printed substrate composite panels, the printing apparatus and methods described herein may also facilitate a thinner finished panel, reducing weight and increasing the sensitivity of through-the-glass touch controls.

Referring now to the drawings and the illustrative embodiments depicted therein, a screen printing apparatus 10 includes a print head assembly 12, a substrate fixture 14, and a screen support frame 16, all mounted to a main framework or support frame 18, such as shown in FIGS. 1, 3-5, and 7. In the illustrated embodiment, print head assembly 12 includes three actuatable biasing elements 42*a-c* supported in spaced arrangement along a laterally-aligned carriage or crossbar 22. Biasing elements 42*a-c* cooperate to support a wiper assembly 24 that is drawn across a screen 26 and a printing substrate 28 during a printing operation, as will be described in more detail below. Print head assembly 12 is supported by a pair of support rails or rods 30 that pass through a pair of sliding supports 32 on either side of a middle biasing element 42*b*. Sliding supports 32 guide print head assembly 12 along the rails 30 during screen printing operations. Biasing elements 42*a-c* are independently controllable or actuatable so as to adjust the degree of pressure applied to wiper assembly 24, against the screen 26 and printing substrate 28, to thereby accommodate and account for one or more curved regions 28*a* of printing substrate 28 as the print head assembly 12 moves during the printing operation. This allows for consistent application of ink(s) (including translucent inks, if desired) to printing substrate 28, including curved regions 28*a*, to thereby enable the use of screen printing methods on curved surfaces, including concave curved surfaces (e.g., in curved region 28*a*) and/or compound curved surfaces or the like.

Wiper assembly 24 includes a flexible elongate wiper blade or squeegee 34 having a first end or side portion 34*a* and a second end or side portion 34*b* opposite the first end portion 34*a*, such as shown in FIGS. 9-12. It should be appreciated that the term "end or side portion," as used herein, is intended to refer to an entire section of the part, which may optionally include the extreme ends of the part, such as first end 36*a* and second end 36*b* of wiper blade 34 (FIGS. 9-10), and that a given "end portion" could include a midpoint of the part. In the illustrated embodiment, wiper blade 34 further includes a middle region or portion 34*c* between the first and second side portions 34*a*, 34*b*.

In the illustrated embodiment, wiper blade 34 is grasped and held along its length by three separate clamping members 38*a-c*, which are spaced slightly apart from one another, and which engage the wiper blade 34 at the first and second side portions 34*a*, 34*b*, and at middle region 34*c*, respectively, such as shown in FIGS. 9-11, 13 and 14. Each clamping member 38*a-c* is engaged or held by a respective bracket 40*a-c*, which brackets are located at respective distal end portions of respective actuatable biasing elements 42*a-c*. The actuatable biasing elements 42*a-c* are mounted at their proximal end portions to the carriage or crossbar 22, and are independently actuatable to extend and retract respective main support shafts 44, to which the brackets 40*a-c* are attached.

In the illustrated embodiment, biasing elements 42*a-c* are pneumatic double-acting piston-cylinder actuators that are spaced apart from one another along crossbar 22. In addition to support shafts 44, each biasing element 42*a-c* has a pair of actuating shafts 46 that extend upwardly through respective bushings in crossbar 22 and have a lower ends fitted with pistons (not shown) that are supported in respective cylinders 47, and which receive pressurized air or hydraulic fluid from fluid lines (not shown) to provide the biasing forces of biasing elements 42*a-c*. Support shafts 44 hold respective brackets 40*a-c* and are provided to support and resist the significant bending moments imparted to wiper assembly 24 as the wiper blade 34 is pushed against the screen 26 and printing substrate 28 during the screen printing operation. Upper ends of the support shafts 44 and actuating shafts 46 are coupled together by respective plates 48 and clamping collars 50, to ensure that the shafts 44, 46 move in a synchronized and mutually-supporting manner for each of the respective biasing elements 42*a-c*. Although biasing elements 42*a-c* are described as pneumatic or hydraulic cylinder units, it will be appreciated that similar force control may be achieved using electric linear actuators such as servo motors, rotary actuators, cam actuators, or the like. It will be appreciated that pneumatic cylinders provide some variability in the extension and retraction of the wiper under load, due to compressibility of the air used as a working fluid. While electric and/or hydraulic actuators may not themselves provide such variability, it is envisioned that resilient/compressible members may be introduced between the actuator(s) and the wiper blade to provide a shock absorbing or "buffer" function, if desired.

Because wiper blade or squeegee 34 is a flexible member, which may be made from silicone, rubber, or rubber-like material, for example, downward forces applied to blade 34 by middle biasing element 42*c* (acting through bracket 40*c* and clamping member 38*c*) will tend to be concentrated in the area of middle region 34*c* of wiper blade 34. Similarly, downward forces applied to blade 34 by first biasing element 42*a* (acting through bracket 40*a* and clamping member 38*a*) will tend to be concentrated in the area of first end portion 34*a* of the wiper blade, while downward forces applied to wiper blade 34 by second biasing element 42*b* (acting through bracket 40*b* and clamping member 38*b*) will tend to be concentrated in the area of second end portion 34*b* of the wiper blade 34. Therefore, by independently actuating the biasing elements 42*a-c* the forces applied to wiper blade 34 can be varied along the length of the wiper blade, and can also be changed as the wiper blade is drawn along screen 26 and printing substrate 28. This allows appropriate pressure to be maintained between areas or regions of the wiper blade 34 and the screen 26 and printing substrate 28, including as the wiper blade 34 moves along curved regions 28*a* of the printing substrate 28.

Although the print head assembly 12 of the illustrated embodiment includes three biasing elements 42*a-c* and corresponding components of wiper assembly 24, for supporting and engaging three respective regions 34*a-c* of the flexible wiper blade 34, it will be appreciated that a greater or lesser number of biasing elements or actuators may be used for a particular application, without departing from the spirit and scope of the present invention. For example, greater control may be achieved by providing four or more biasing elements or actuators along a flexible wiper blade, such as to accommodate screen printing onto substrates having more complex curvatures in their non-planar regions. For screen printing onto substrates having less complex shapes, it may be sufficient to provide only two biasing elements or actuators acting on two different regions or portions of the wiper blade. Moreover, it is envisioned that biasing elements or actuators may be operated in a coordinated manner that permits pivoting movement of the wiper assembly, and that pivots or hinges or ball joints may also be employed, in combination with one or more rotary or linear actuators, to provide a desired level of control over the pressures applied to different regions of a wiper blade as it moves along a screen and a printing substrate.

As noted above, and with reference to FIGS. 9 and 11, print head assembly 12 includes a pair of sliding supports 32 that receive and slide along respective support rails 30 as the print head assembly 12 moves in a longitudinal direction relative to framework 18, relative to screen support frame 16 fitted with the screen 26, and relative to substrate fixture 14 fitted with printing substrate 28. Although screen printing apparatus 10 has a movable print head assembly 12, it will be appreciated that, in an alternative arrangement, the print head assembly could be held stationary while the screen and printing substrate are moved relative to the print head assembly, without departing from the spirit and scope of the present invention. Sliding supports 32, which may be air bearings or the like, are coupled to crossbar 22 via an ink system rail 52 and a pair of Z-shaped brackets 54. Ink system rail 52 further supports a pair of ink cylinders 56 that supply ink to a flood bar 58 that is supported by a pair of brackets 60, and which distributes ink onto screen 26 during the screen printing operation.

Figure 17:
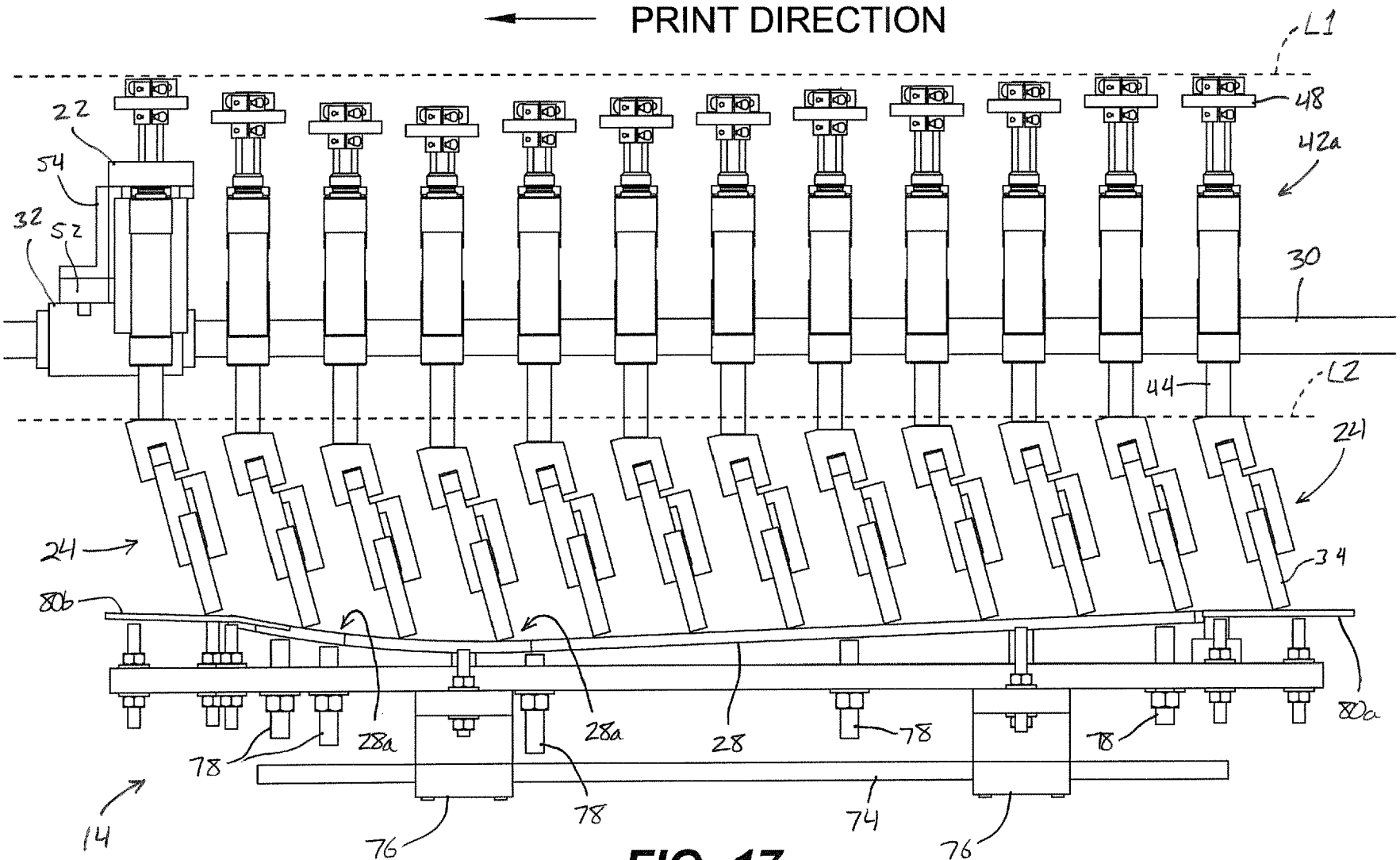
FIG. 17 another left side elevation of the print head assembly, guide rails, and panel fixture of the printing apparatus, and depicting sequential movement of the print head assembly along the guide rails and relative to the panel fixture during a printing operation.

During a printing stroke of print head assembly 12 as shown in FIG. 17 (in which portions of the print head assembly are omitted for clarity), support rails 30, sliding supports 32, crossbar 22, and main bodies of the biasing elements 42*a-c* maintain fixed spacing relative to substrate fixture 14, on which printing substrate 28 is mounted. However, the elevations of the biasing elements' support shafts 44 and actuating shafts 46, and of wiper assembly 24, change along the printing stroke according to (i) the distance between a particular surface portion of printing substrate 28 and support rails 30, and (ii) the pressures or forces applied to wiper assembly 24 by the biasing elements 42*a-c*. To illustrate this, two horizontal dashed lines L1, L2 are superimposed in FIG. 17, so that these elevation changes are more readily apparent. At the beginning of the stroke (at right in FIG. 17), wiper assembly 24 is at its highest elevation of the stroke, and begins to gradually drop along the slight downward slope of a generally planar region (approximately the right two-thirds) of printing substrate 28. Wiper assembly 24 is at its lowest position near the right side of curved region 28*a*, and begins to rise again along curved region 28*a* as the print head assembly finishes its stroke in the print direction, eventually returning to the same elevation at which it started.

In the illustrated embodiment, the printing substrate 28 has a simple concave curve shape at curved region 28*a*, so that suitable screen printing may be achieved by actuating biasing elements 42*a-c* in a coordinated manner, such as by setting their fluid pressures at the same level at each position of the print head assembly 12 relative to the printing substrate 28. As a result, wiper assembly 24 maintains a level orientation, parallel (in the lateral direction) to printing substrate 28, and with each support shaft 44 and actuating shaft 46, and each bracket 40*a-c*, having the same elevations as the other shafts and brackets along the printing stroke. However, for more complex shapes of printing substrates, the elevations of the various shafts 44, 46 and the corresponding brackets 40*a-c* may differ from one another for a given position of print head assembly 12 along the print stroke. The elevations will change according to the shape of the printing substrate and the fluid pressure in each of the biasing elements 42*a-c*.

Therefore, due to the flexibility of wiper blade 34 and the elevation and pressure variables described above, portions of the wiper assembly 24 and the shafts 44, 46 of biasing elements 42*a-c*, may assume different heights or elevations relative to one another along each printing stroke. Although it is envisioned that each biasing element 42*a-c* may have its fluid pressure independently controlled, it would also be possible to supply the same fluid pressure to each biasing element for a given position of the print head assembly 12 relative to the printing substrate 28, either by independent but synchronized control of the fluid pressures, or by using a manifold system so that the same fluid pressure is always supplied to each biasing element 42*a-c* for any given position of the print head assembly.

Figure 2:
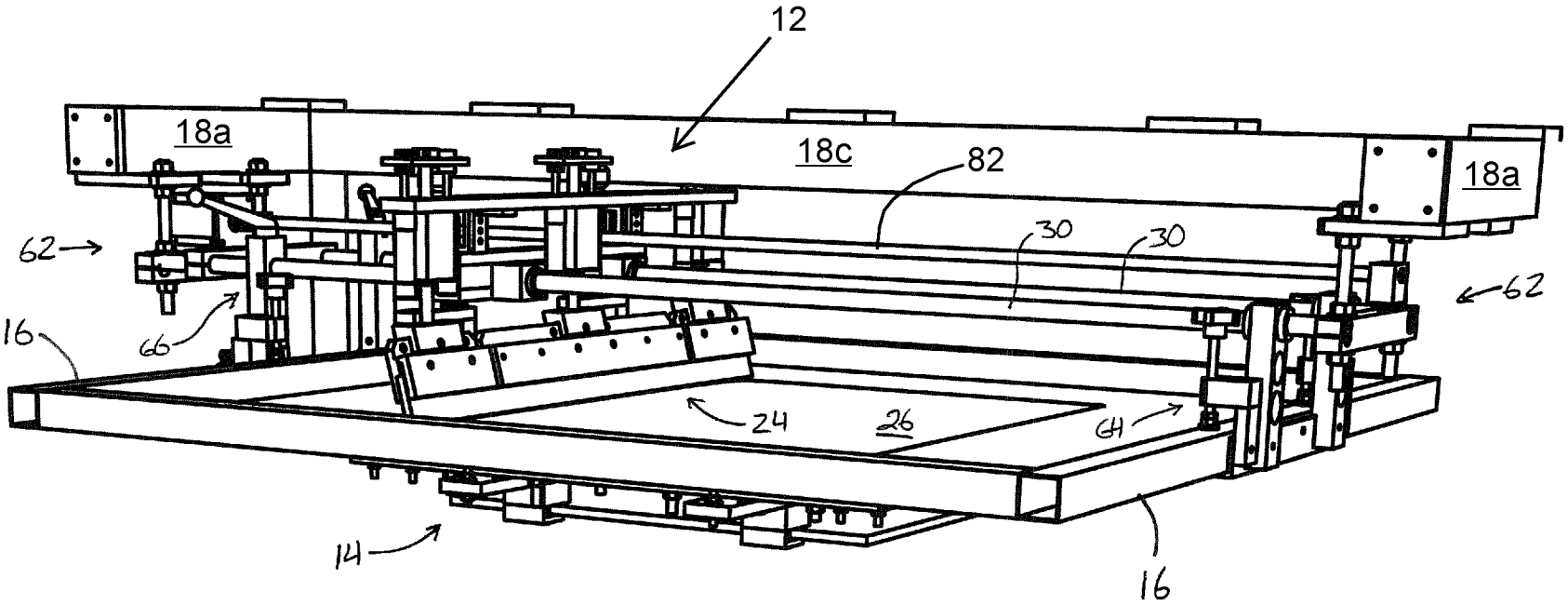
FIG. 2 is an enlarged view of the area designated II in FIG. 1.
Figure 3:
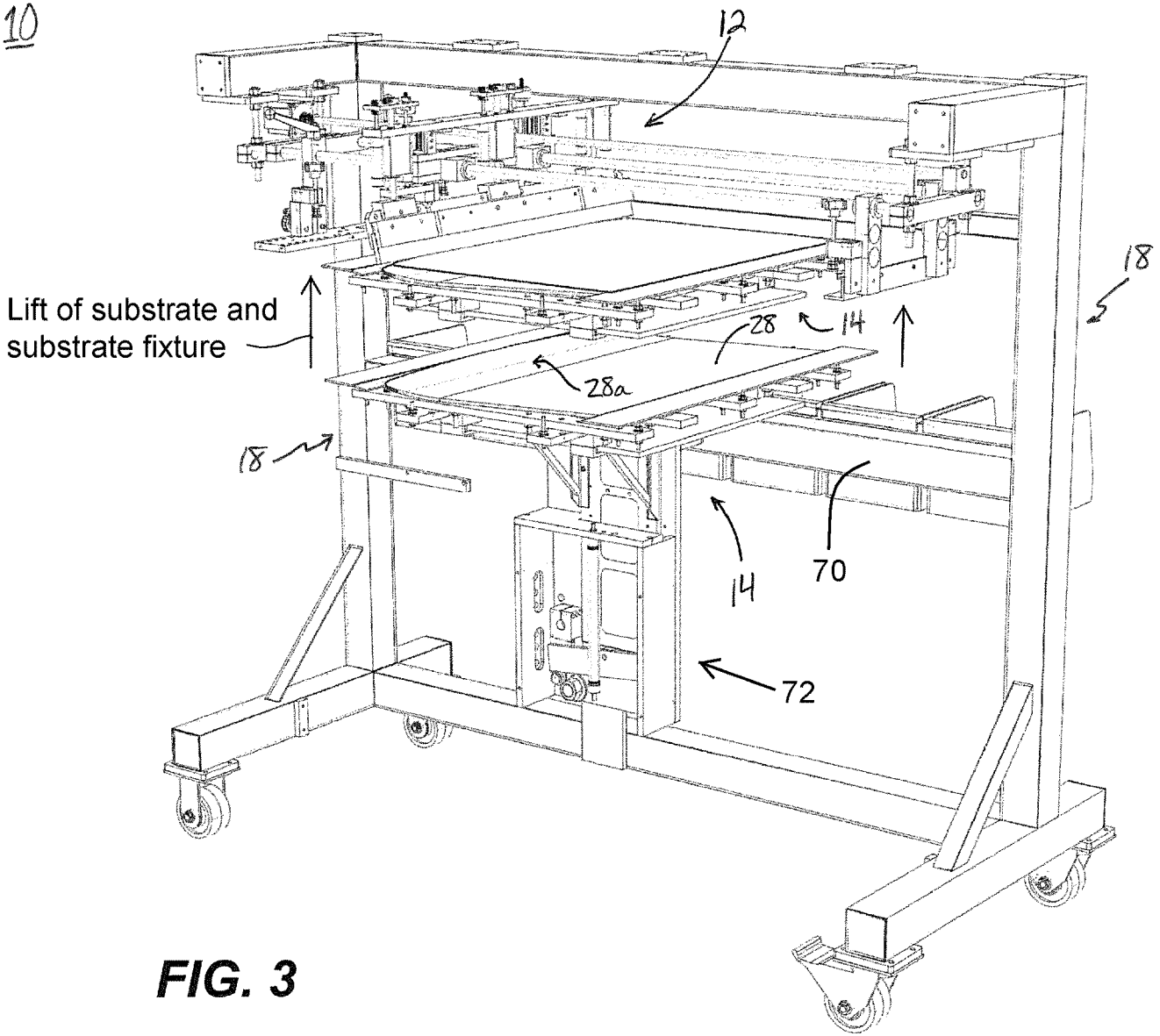
FIG. 3 is another a perspective view of the printing apparatus of FIG. 1, in which the screen frame is removed to show additional structure and the glass panel is shown in both the lowered loading position and a raised printing position.
Figure 4:
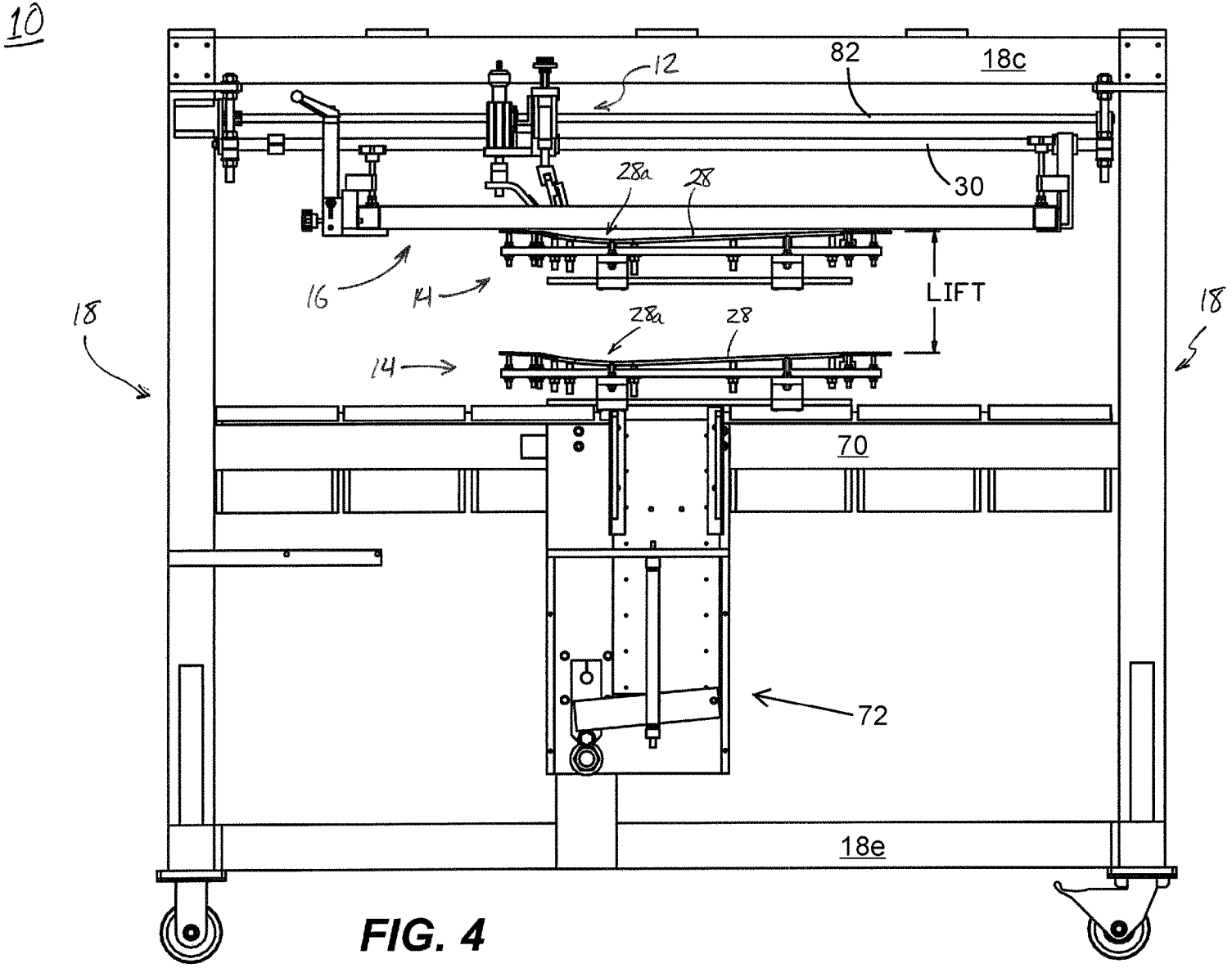
FIG. 4 is a left side elevation of the printing apparatus of FIG. 1.
Figure 5:
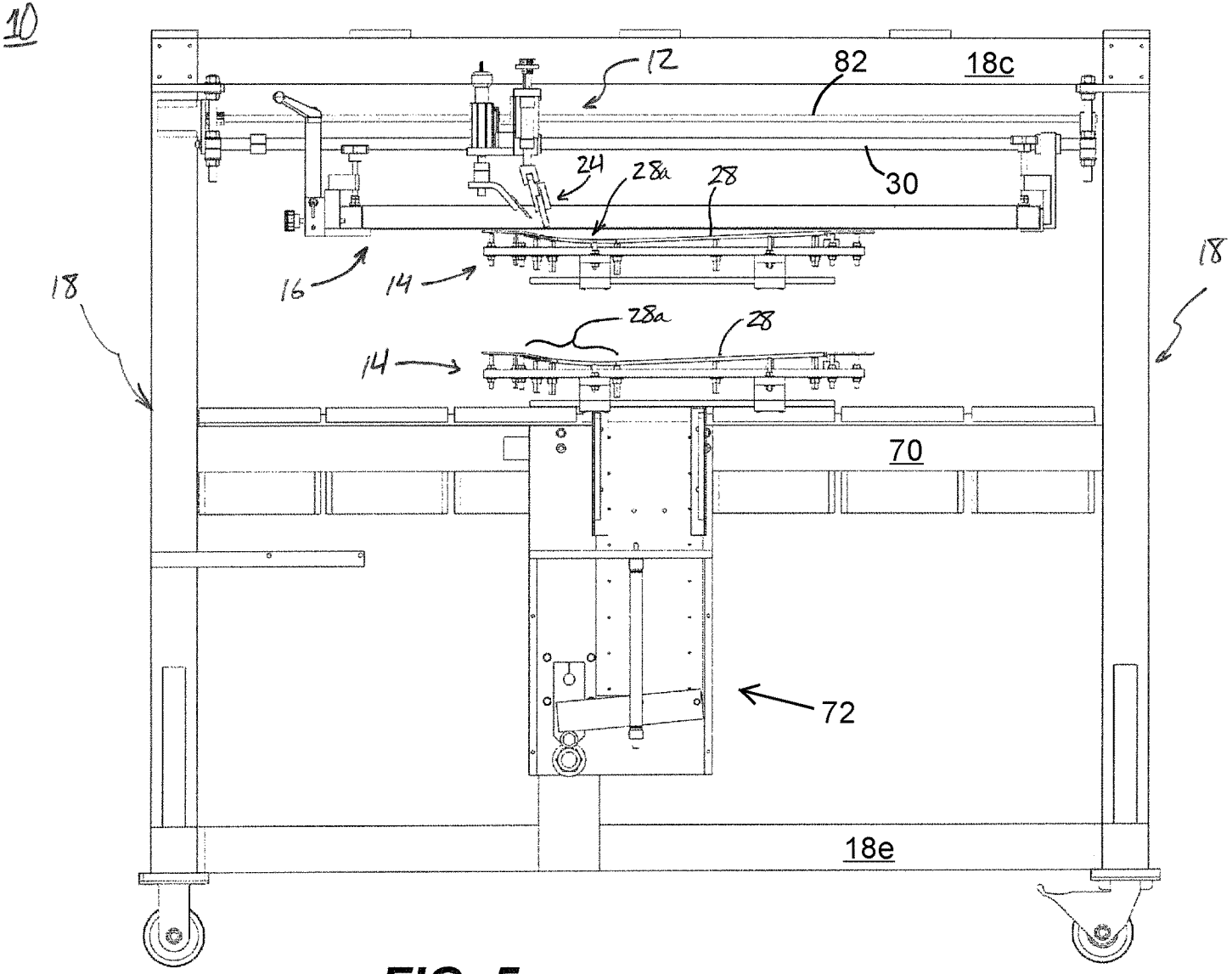
FIG. 5 is another left side elevation of the printing apparatus of FIG. 1, in which the screen frame is removed to show additional structure.

Support rails or rods 30 are supported at their opposite ends by respective adjustable bracket systems 62, such as shown in FIG. 2. Bracket systems 62 also hold screen support frame 16 (via support rails 30) using thumbscrew clamps 64 and slide clamps 66, so that support rails 30 and screen support frame 16 are held in fixed relation to one another. However, it is optionally envisioned that screen support frame 16 may be mounted in a tiltable manner, such as is shown diagrammatically in FIG. 16. Referring to FIG. 1, bracket systems 62 are secured to undersides of respective horizontal overhead frame members 18*a* of framework 18, which in turn are supported in a cantilevered manner by respective upright frame members 18*b* having an upper horizontal frame member 18*c* extending longitudinally along screen printing apparatus 10, between upper ends of the upright frame members 18*b*. Framework 18 further includes a pair of lower laterally-aligned horizontal frame members 18*d* at lower ends of the upright frame members 18*b*, a lower horizontal frame member 18*e* extending longitudinally along a bottom of the screen printing apparatus 10, and a pair of diagonal braces 18*f* to support the upright frame members 18*b*. In the illustrated embodiment, each of the lower laterally-aligned horizontal frame members 18*d* includes a pair of caster wheels 68 so that screen printing apparatus 10 is a portable system. However, it will be appreciated that the configuration of framework or other support structure is incidental to the screen printing apparatus.

Figure 15:
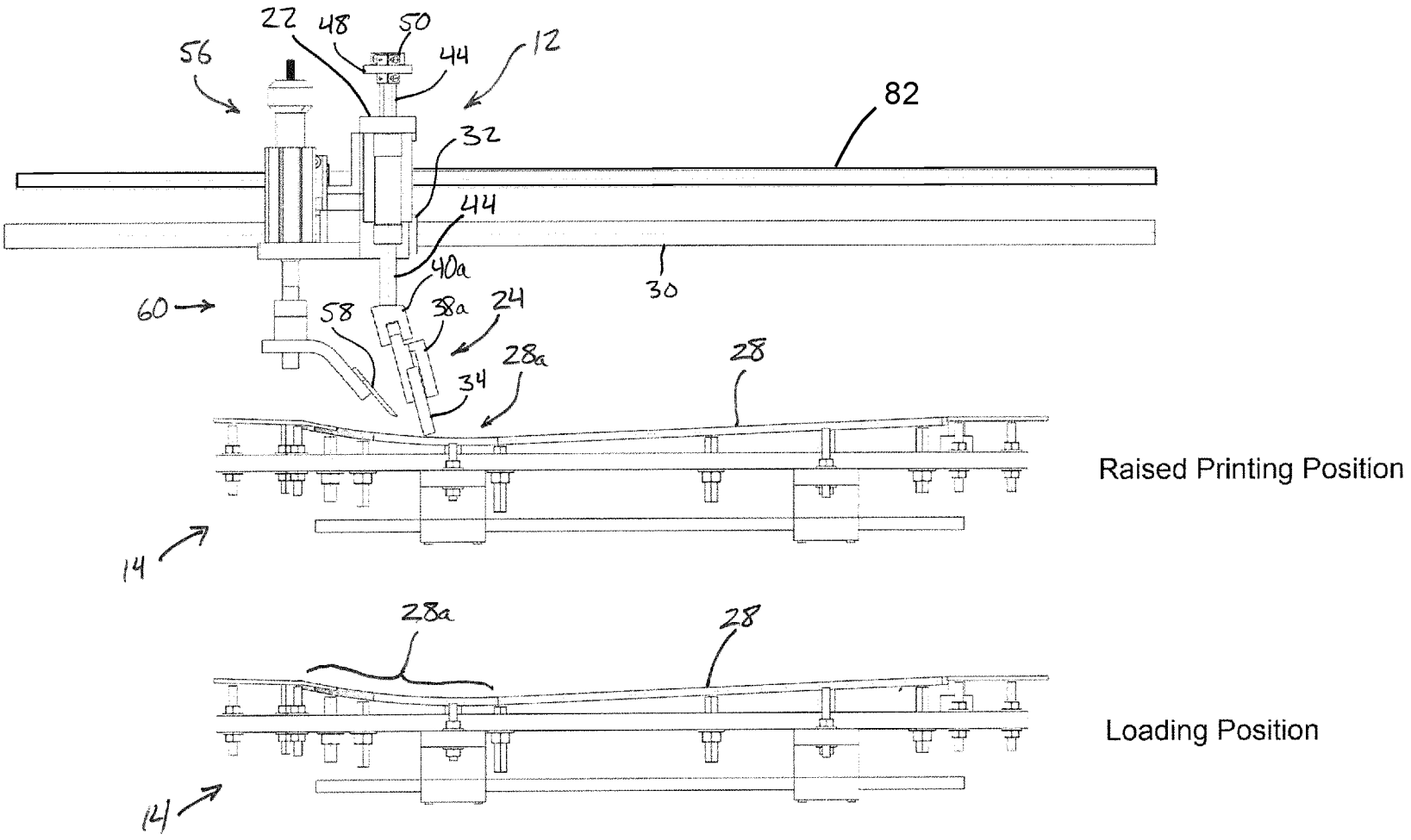
FIG. 15 is a left side elevation of the print head assembly, guide rails, and panel fixture of the printing apparatus, shown with the panel fixture in lowered and raised positions and with a glass panel fixed thereto.

Substrate fixture 14 is supported by a horizontal longitudinal rail 70 that spans between upright frame members 18*b* and is spaced vertically between upper and lower horizontal frame members 18*c*, 18*e*. A lifting mechanism 72 is supported on lower horizontal frame member 18*e*, and is operable to raise and lower substrate fixture 14, on longitudinal rail 70, between a lower loading position and a raised printing position, such as shown in FIG. 15, and also as shown in FIGS. 1, 3-5 and 7 (in which, for clarity, only substrate fixture 14 and printing substrate 28 are shown in both the lowered and raised positions). As best shown in FIG. 17, substrate fixture 14 is configured with a support rail 74 having longitudinally-adjustable brackets 76, which have a plurality of height-adjustable support pegs 78 (which may be threaded shafts) that are adjustable to accommodate different shapes of printing substrates, such as the illustrated glass panel substrate 28. In addition, substrate fixture 14 may include a pair of end plates 80*a*, 80*b* that are positioned at opposite ends of printing substrate 28, and which are contacted by wiper blade 34 at opposite ends of the printing stroke where the blade disengages the printing substrate.

It will be appreciated that it is advantageous to utilize an automated or computerized control system, such as servo motor motion, to control the various operating features of screen printing apparatus 10 in a coordinated manner for a given printing substrate 28, such as a curved glass panel. Computerized control systems provide repeatability, efficiency, and speed that are desirable for commercial manufacturing applications. However, PLC operation and communication with motion controllers (e.g., servo drives) may be more reliable and efficient than separate computers for controlling the operations of printing apparatus 10 in a desired manner. The monitored and/or controllable operating features of screen printing apparatus 10 may include ink flow, print head direction and speed, pressure or force applied by each biasing element 42*a-c*, raising and lowering of substrate fixture 14 with printing substrate 28, and tilt angle (if applicable) of screen support frame 16.

Therefore, screen printing apparatus 10 may be equipped with a programmable computer processor or programmable logic controller ("PLC") (not shown) that can access and/or execute one or more programs or repeatable operation sequences corresponding to a particular printing substrate 28. For example, the shape and overall dimensions of the printing substrate will dictate the appropriate travel distance of print head assembly 12 relative to printing substrate 28 on each stroke, and will also dictate the appropriate force or pressure applied by each biasing element 42*a-c* at each position of wiper assembly 24 relative to printing substrate 28. Thus, it is envisioned that a computer program or operating sequence instructions, corresponding to a particular printing substrate 28, will include instructions specifying the fluid pressure to be supplied to each individual biasing element 42*a-c* (assuming pneumatic or hydraulic biasing elements) according to the position of wiper assembly 24 and a longitudinal direction, which corresponds to the position of wiper blade 34 relative to printing substrate 28 including any curved regions 28*a*.

Figure 6:
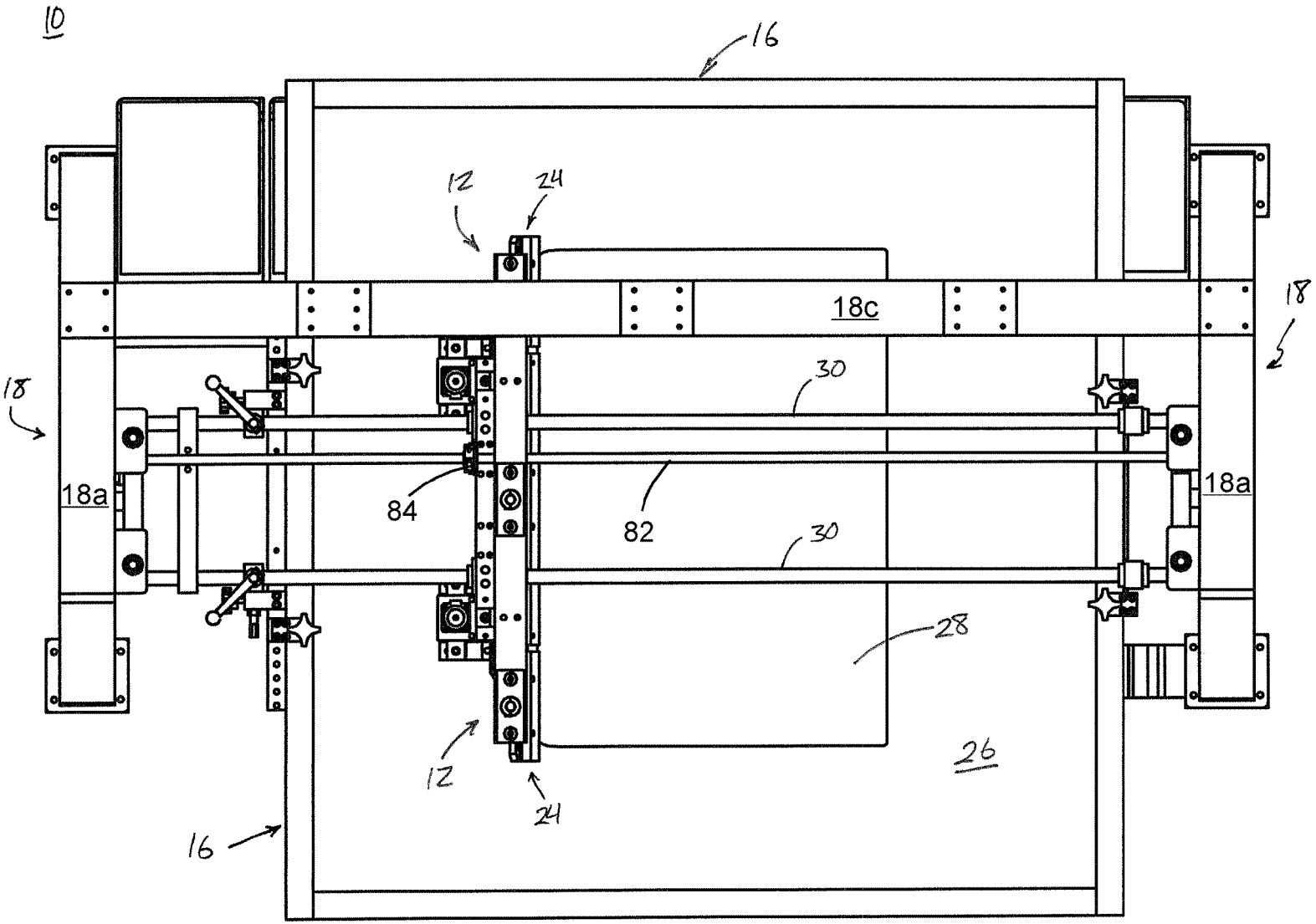
FIG. 6 is a top plan view of the printing apparatus of FIG. 1.
Figure 7:
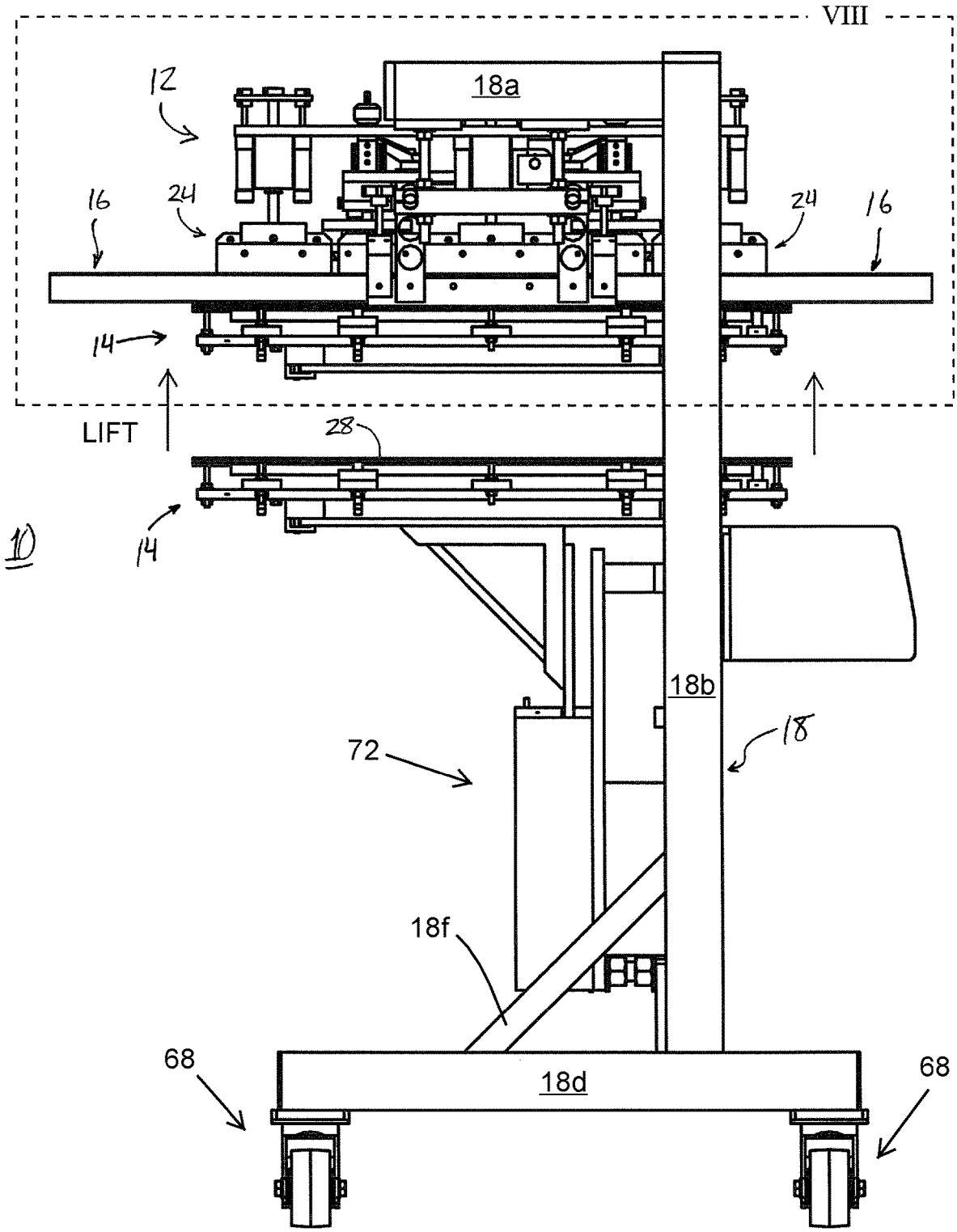
FIG. 7 is a rear end elevation of the printing apparatus of FIG. 1.
Figure 8:
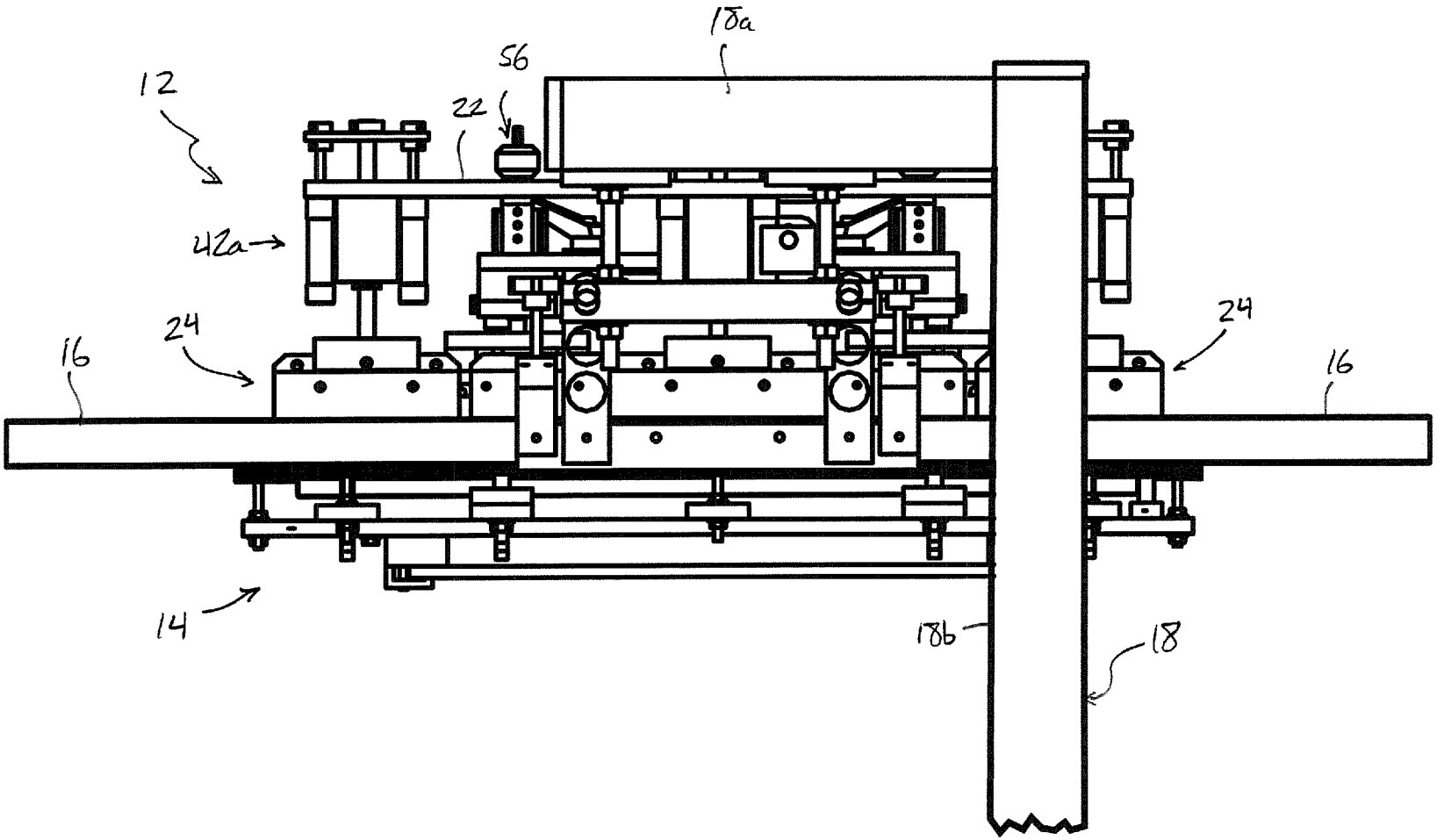
FIG. 8 is an enlarged view of the area designated VIII in FIG. 7.
Figure 9:
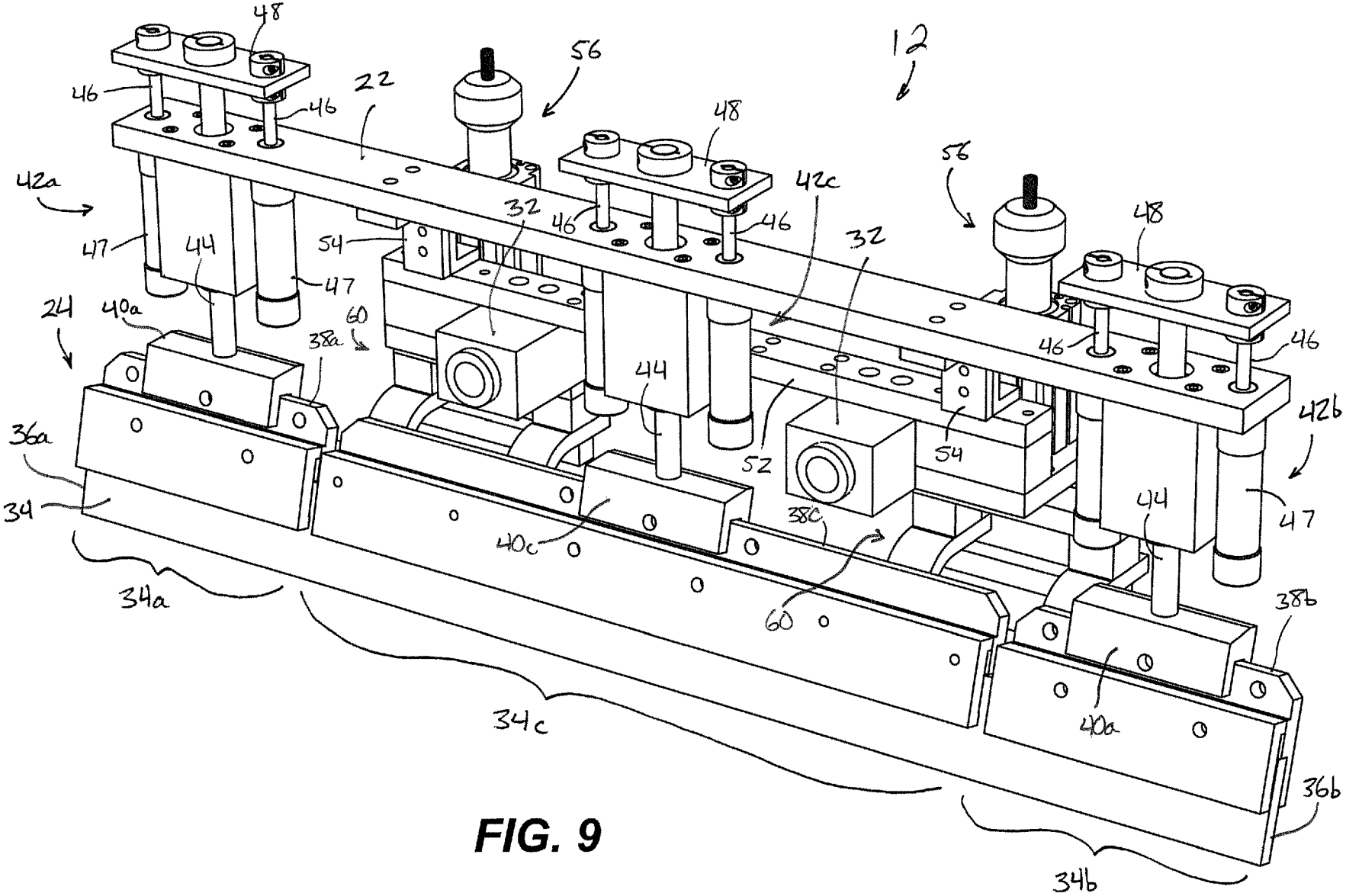
FIG. 9 is a perspective view of the trailing end of the print head assembly of the printing apparatus of FIG. 1.
Figure 10:
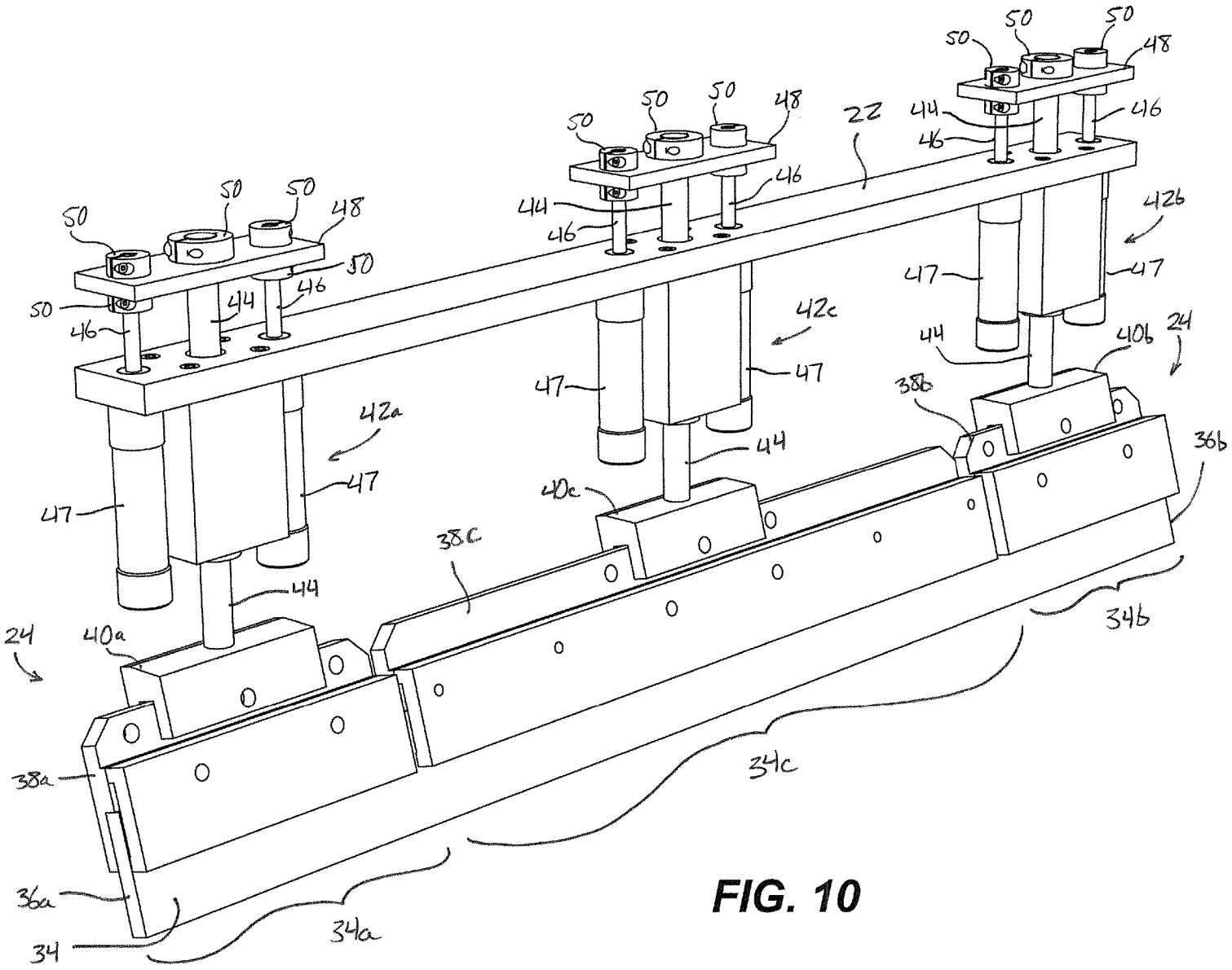
FIG. 10 is another perspective of the trailing end of a squeegee and support portion of the print head assembly, with printing structure omitted for clarity.
Figure 11:
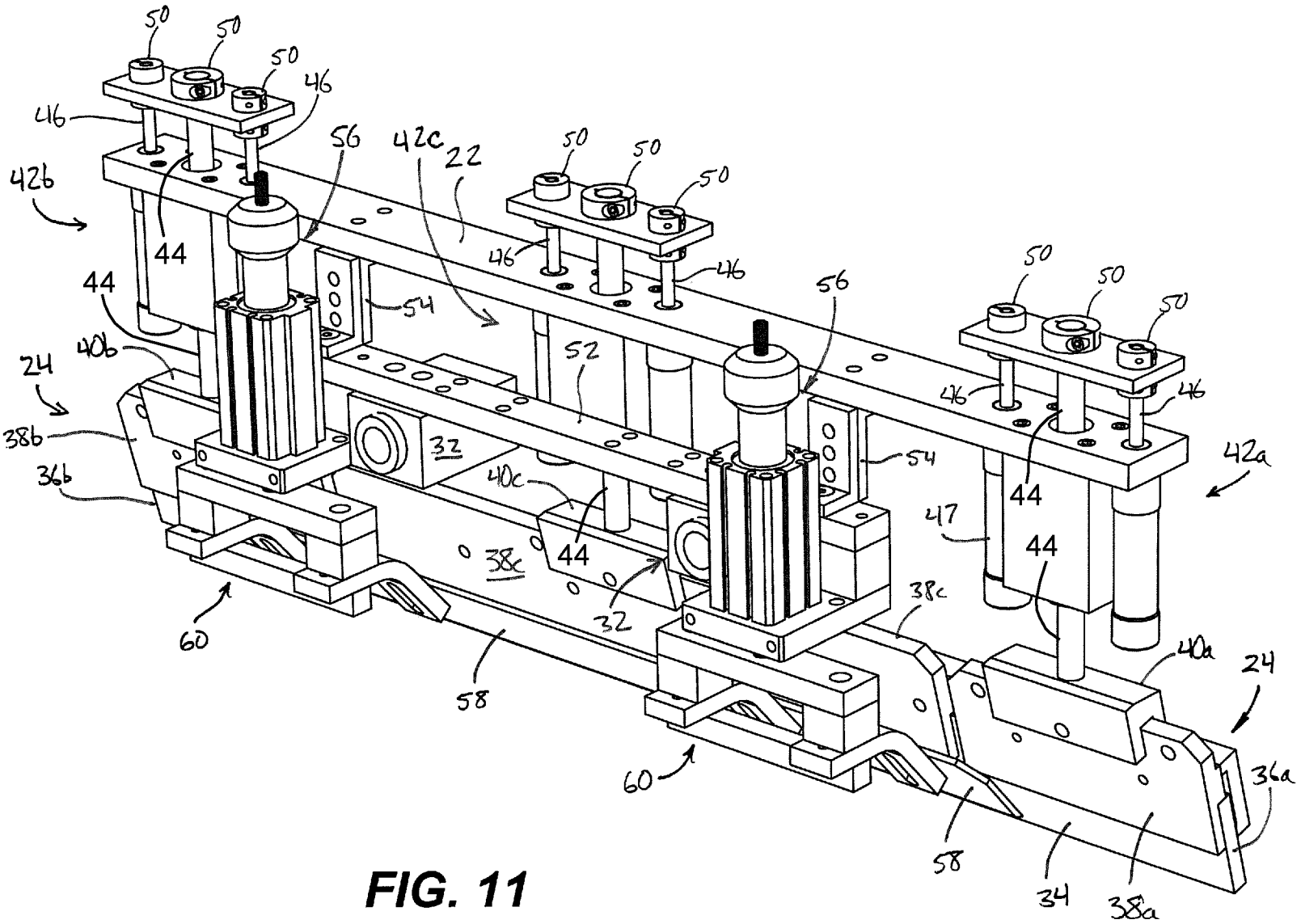
FIG. 11 is a perspective view of the leading end of the print head assembly of FIG. 9.
Figure 12:
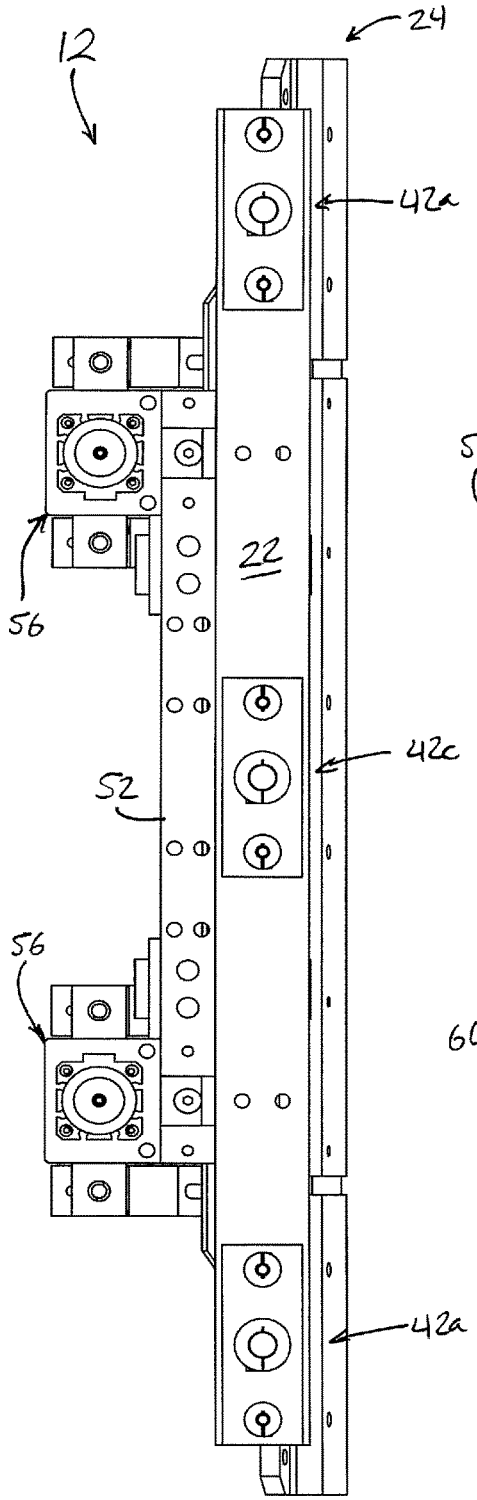
FIG. 12 is a top plan view of the print head assembly of FIG. 9.
Figure 13:
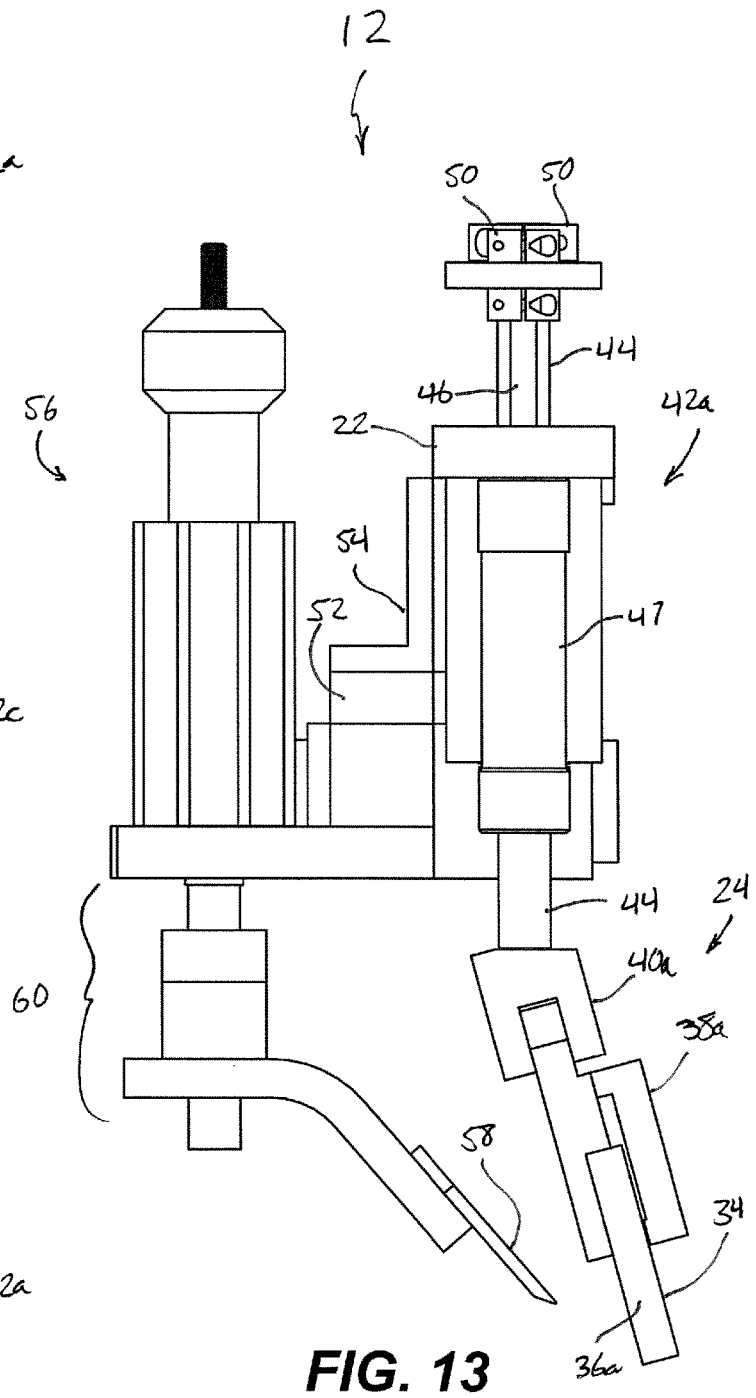
FIG. 13 is a left side elevation of the print head assembly of FIG. 9.
Figure 14:
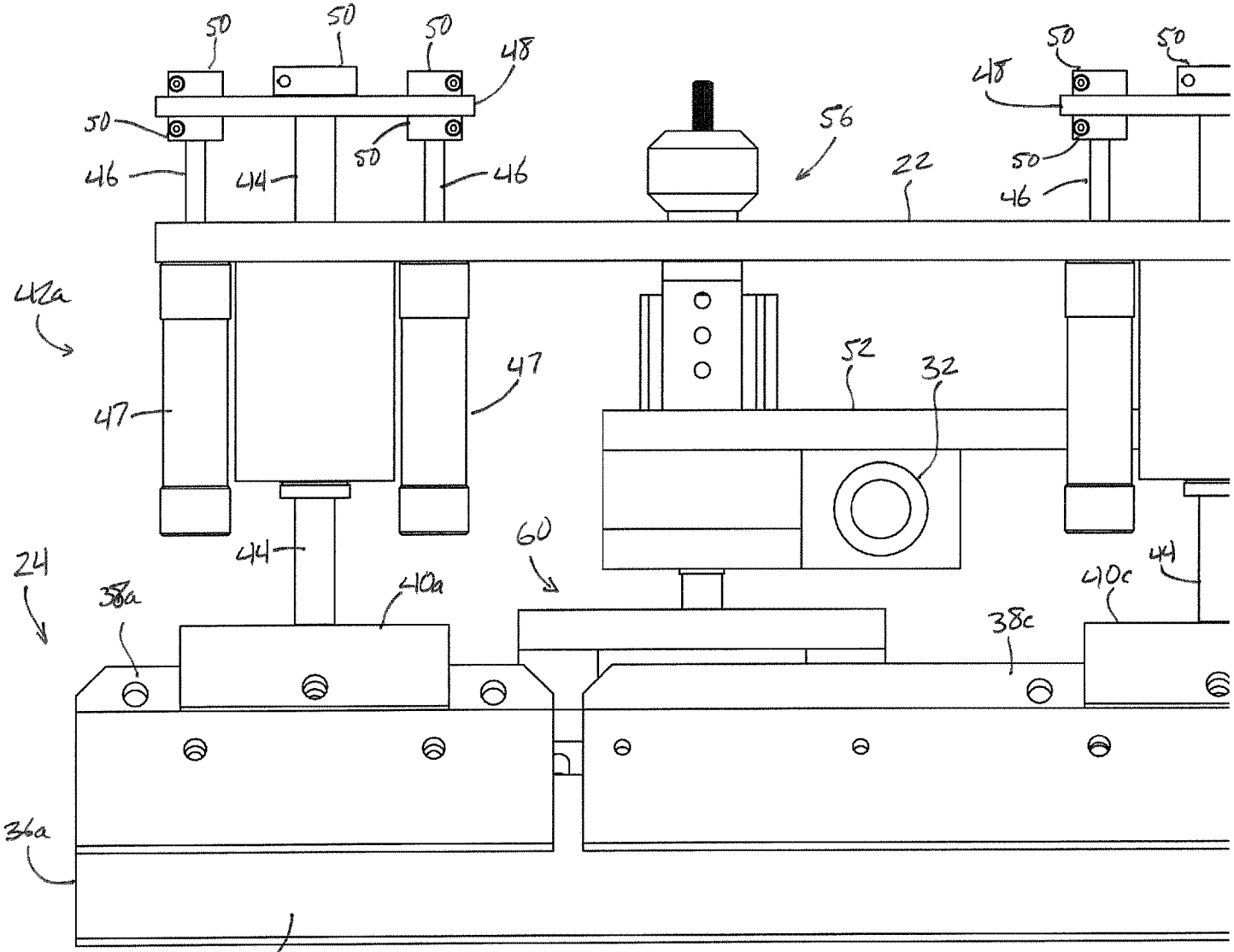
FIG. 14 is a rear end elevation of a left side portion of the print head assembly of FIG. 9.

In the illustrated embodiment, an optical or magnetic linear encoder is used to detect the linear position of print head assembly 12 relative to printing substrate 28, with linear position signals being fed to the PLC and used to determine the force or pressure to apply at each biasing element 42*a-c* at each position of wiper assembly 24 relative to printing substrate 28. The linear encoder includes a longitudinal encoder shaft 82 mounted above and parallel to support rails 30, and fixed to support frame 18, such as shown in FIGS. 1, 2, 4-6, 15 and 16. Encoder shaft 82 includes optical or magnetic indicia along its length, which are detectable by a reader 84 that is mounted to print head assembly 12, such as shown in FIG. 6. Main support shafts 44 and actuating shafts may be supported using low friction linear bearings, so that fluid pressure in biasing elements 42*a-c* can be closely correlated to the pressure applied by wiper blade 34 to screen 26 and printing substrate 28.

The method for printing on curved substrate surfaces using the screen printing apparatus 10 will already be apparent from the above descriptions, and are summarized hereinbelow. First, substrate fixture 14 is lowered to its loading position using a lifting mechanism 72, and a fresh (unprinted) printing substrate 28 is mounted to the fixture 14. Substrate fixture 14 is then raised to the printing position with lifting mechanism 72, with screen 26 lying against (or in close proximity to) the upper surface of printing substrate 28. Ink cylinders 56 emit ink down along flood bar 58 and onto an upper surface of screen 26, on a leading side of wiper blade 34 (i.e., to the left of blade 34 as viewed in FIGS. 15-17). Fluid pressure is supplied to biasing elements 42*a-c* so that wiper blade 34 will engage screen 26 and printing substrate 28 with the desired force along each region or portion 34*a-c* of the wiper blade 34, as print head assembly 12 is driven in a longitudinal direction along support rails 30. The longitudinal driving force applied to print head assembly 12 may be supplied by a leadscrew or other screw drive arrangement, hydraulic or pneumatic cylinders, servo motors, or substantially any other linear actuators capable of sufficiently precise control and coordination with forces applied by biasing elements 42*a-c*.

Figure 16:
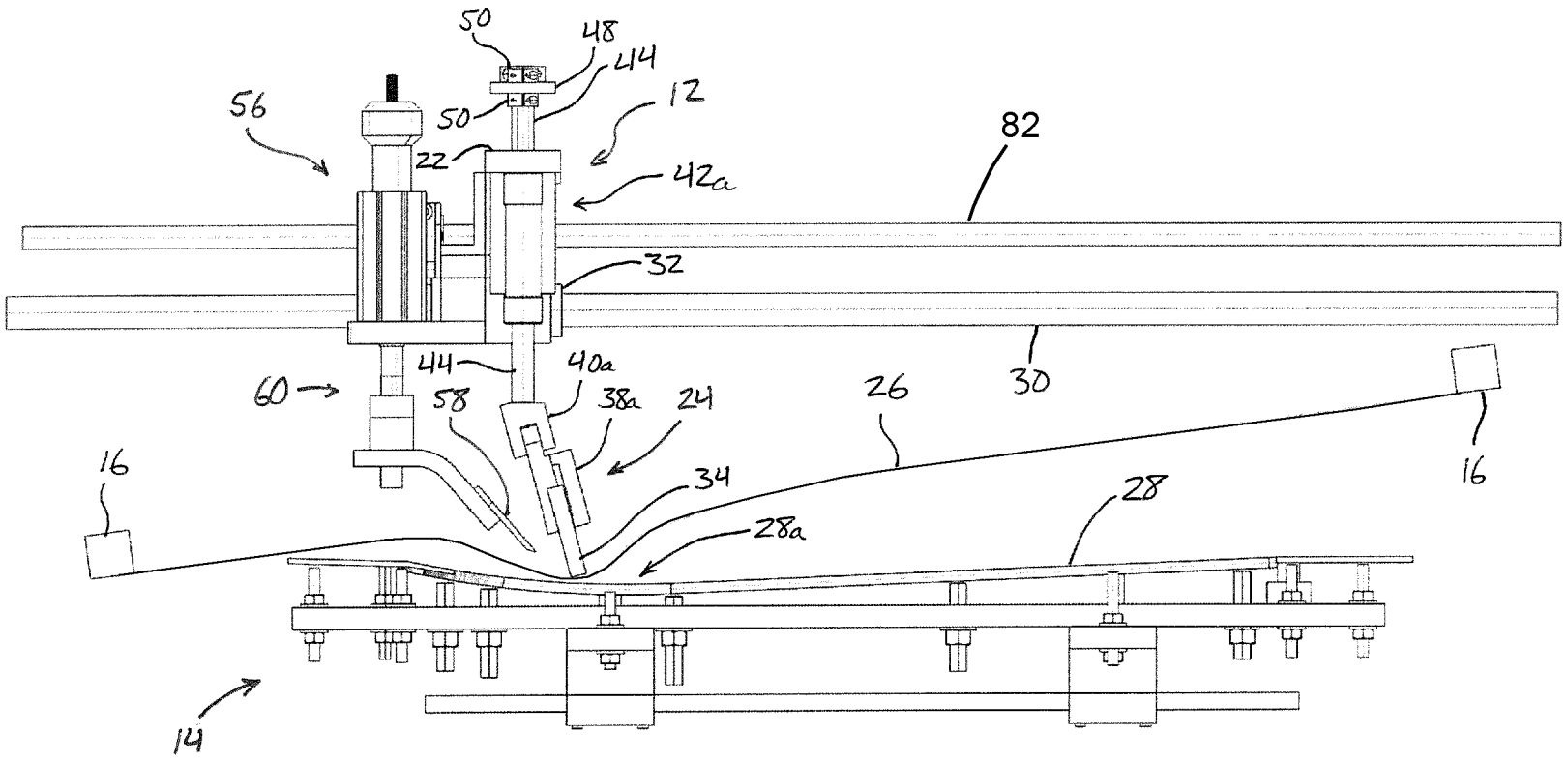
FIG. 16 is another left side elevation of the print head assembly, guide rails, and panel fixture of the printing apparatus, shown during a printing operation.

As wiper blade 34 moves along sloped and/or curved regions (such as curved region 28*a*) of printing substrate 28, the fluid pressure supplied to each biasing element 42*a-c* is changed as needed to apply appropriate pressure to a corresponding region 34*a-c* of wiper blade 34. As described above, the fluid pressure supplied to each biasing element 42*a-c* may be different at each position of the print head assembly 12, or the same fluid pressure may be supplied to each biasing element 42*a-c*, as desired for a given printing substrate. Optionally, screen support frame 16 and screen 26 may be tilted during the printing operation, such as shown in FIG. 16, in order to maintain a desired angle of the screen 26 (e.g., parallel) relative to printing substrate 28 in the vicinity of wiper blade 34. An optimal screen tension for a particular application may be determined through testing, in order to minimize distortion along different regions of printing substrate 28. Optionally, screen tension may vary along the length of the screen 26 to achieve desired printing results along the printing substrate 28.

After completion of a printing stroke, print head assembly 12 may be driven in the opposite direction back to its beginning position, either with wiper blade 34 still in contact with screen 26 and applying pressure to printing substrate 28, or with substrate fixture 14 lowered so as to disengage the wiper blade 34 during the return stroke. It will be appreciated that the fluid pressures in the biasing elements 42*a-c* may be varied on the return stroke in substantially the same manner as on the printing stroke, as desired. In addition, repeat strokes may be used until the desired amount of ink has been applied to the printing substrate 28. Optionally, the screen 26 may be replaced with a different screen, such as to apply a different color, pattern, or the like during subsequent print strokes. Once the screen printing is complete, substrate fixture 14 is lowered and the printing substrate 28 is removed for any post-printing curing steps (e.g., U.V. light or heating), and a new printing substrate may be positioned at the substrate fixture for printing.

Accordingly, the screen printing method and apparatus of the present invention facilitate the efficient application of colors, patterns, and other indicia onto printing substrates having curved surfaces to be printed. A print head assembly includes biasing elements, such as hydraulic or pneumatic actuators, with movable end portions that support a wiper and apply varying levels of pressure to the wiper as it is moved along the curved surface or surfaces of the substrate. The print head assembly and associated screen printing equipment may be automated or computer controlled to facilitate consistent and repeatable performance for a given surface to be printed, by varying the pressure of the biasing elements and the pressure of different areas of the wiper along the substrate.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A screen printing apparatus comprising:

a support frame;

a substrate fixture coupled to said support frame and configured for holding a printing substrate having a printable surface with a non-planar region;

a print head assembly supported at said support frame and spaced from said substrate fixture, wherein said print head assembly comprises:

first and second actuatable biasing elements having respective distal end portions spaced apart from one another; and an elongate wiper coupled to said distal end portions of said actuatable biasing elements, said wiper having first and second end portions opposite one another; and a screen support frame and a screen coupled thereto, wherein said screen is disposed between said wiper and said substrate fixture;

wherein said distal end portion of said first biasing element is coupled to said wiper at said first end portion of said wiper, and said distal end portion of said second biasing element is coupled to said wiper at said second end portion of said wiper;

wherein said first and second actuatable biasing elements are operable to apply varying forces to said wiper in the direction of said substrate fixture as said print head assembly and said substrate fixture are moved relative to one another with said wiper moving along the non-planar region of the printing substrate while printing to the printable surface; and wherein said screen support frame and said screen are pivotable together relative to said wiper and said substrate fixture as said wiper moves along the printing substrate during a printing operation.

2. The screen printing apparatus of claim 1, further comprising an elongate support rail coupled to said support frame and configured to support said print head assembly.

3. The screen printing apparatus of claim 2, further comprising a linear actuator operable to move said print head assembly in a print direction along said support rail.

4. The screen printing apparatus of claim 1, wherein said elongate wiper comprises a middle region located between said first and second end portions, and wherein said screen printing apparatus further comprises a third actuatable biasing element having a distal end portion spaced between said distal end portions of said first and second actuatable biasing elements and coupled to said elongate wiper at said middle region, wherein said third actuatable biasing element is operable to apply varying forces to said middle region of said wiper as said print head assembly and said substrate fixture are moved relative to one another during the printing operation.

5. The screen printing apparatus of claim 1, wherein said first and second actuatable biasing elements are independently operable to apply different and varying forces to respective ones of said regions of said wiper as said print head assembly and said substrate fixture are moved relative to one another during the printing operation.

6. The screen printing apparatus of claim 1, wherein said actuatable biasing elements comprise pneumatic or hydraulic piston actuators.

7. The screen printing apparatus of claim 3, further comprising a programmable computer processor that is operable to access and execute a computer program containing instructions for an actuation sequence, wherein said computer processor is operable to actuate, in a programmed sequence, one or more of (i) said biasing elements, (ii) a lifting actuator coupled to said substrate fixture, (iii) said linear actuator, (iv) an ink emitter coupled to said print head assembly, and (v) a pivot actuator coupled to said screen support frame.

8. A screen printing head assembly comprising:

a carriage configured to be movable relative to (i) a substrate fixture and (ii) a printing substrate mounted to the substrate fixture;

first and second actuatable biasing elements having respective proximal end portions coupled to said carriage, and respective movable distal end portions spaced apart from one another and extending away from said carriage;

an elongate wiper coupled to said distal end portions of said actuatable biasing elements, said wiper having first and second end portions disposed opposite one another; and a screen support frame and a screen coupled thereto, wherein said screen is disposed between said wiper and said substrate fixture;

wherein said distal end portion of said first biasing element is coupled to said wiper at said first end portion thereof, and said distal end portion of said second biasing element is coupled to said wiper at said second end portion thereof;

wherein said first and second actuatable biasing elements are operable to apply varying forces to said wiper as said printing head assembly is moved relative to the substrate fixture with said wiper moving along a non-planar region of the printing substrate while printing to the printable surface during a printing operation; and wherein said screen support frame and said screen are pivotable together relative to said wiper and said substrate fixture as said wiper moves along the printing substrate during the printing operation.

9. The screen printing head assembly of claim 8, further comprising a middle region of said elongate wiper, disposed between said first and second end portions, and a third actuatable biasing element having a distal end portion spaced between said distal end portions of said first and second actuatable biasing elements and coupled to said elongate wiper at said middle region, wherein said third actuatable biasing element is operable to apply varying forces to said middle region of said wiper as said printing head assembly is moved relative to the substrate fixture during the printing operation.

10. The screen printing head assembly of claim 8, wherein said first and second actuatable biasing elements are independently operable to apply different and varying forces to said first and second end portions of said wiper, respectively, as said printing head assembly is moved relative to the substrate fixture during the printing operation.

11. The screen printing head assembly of claim 8, further in combination with a support frame, and a substrate fixture coupled to said support frame and configured for holding a printing substrate having a printable surface with a non-planar region.

12. The screen printing head assembly of claim 8, wherein said actuatable biasing elements comprise pneumatic or hydraulic piston actuators.

13. The screen printing head assembly of claim 8, further comprising a programmable computer processor that is operable to access and execute a computer program containing instructions for an actuation sequence, wherein said computer processor is operable to actuate, in a programmed sequence, one or more of (i) said first and second actuatable biasing elements, (ii) a lifting actuator coupled to said substrate fixture, (iii) an ink emitter coupled to said printing head assembly, and (iv) a pivot actuator coupled to said screen support frame.

14. A method of screen printing a substrate having a printable surface with a non-planar region, said method comprising:

positioning the substrate at a substrate fixture;

moving a print head assembly relative to the substrate fixture and the substrate, wherein the print head assembly comprises (i) first and second actuatable biasing elements having respective distal end portions spaced apart from one another, and (ii) an elongate wiper having a first end portion coupled to the distal end portion of the first actuatable biasing element, and a second end portion coupled to the distal end portion of the second actuatable biasing element;

positioning a screen mounted to a screen support frame between the wiper and the substrate;

wherein during said moving the print head assembly, the wiper moves along the non-planar region of the printing substrate and a spacing between the printing substrate and a portion of the print head assembly varies as the print head assembly moves in a first direction relative to the substrate, wherein the spacing is measured in a second direction that is substantially orthogonal to the first direction;

applying varying forces to the first and second end portions of the wiper via the first and second actuatable biasing elements as the wiper moves along the non-planar region of the printing substrate;

pivoting the screen support frame and the screen relative to the wiper and the substrate fixture during said moving the print head assembly relative to the substrate fixture and the substrate; and directing a flowable ink onto the non-planar region of the printing substrate as the wiper moves along the non-planar region of the printing substrate.

15. The method of claim 14, wherein said applying varying forces to the first and second end portions of the wiper comprises independently actuating the first and second actuatable biasing elements during said moving of the print head assembly.

16. The method of claim 15, wherein the first and second actuatable biasing elements comprise piston-cylinder actuators, and wherein said independently actuating the first and second actuatable biasing elements comprises directing a working fluid into the first and second actuatable biasing elements.

17. The method of claim 14, wherein said moving the print head assembly relative to the substrate fixture and the substrate comprises driving a portion of the print head assembly in a substantially linear horizontal path in the first direction, wherein the linear horizontal path is spaced vertically above the substrate.

18. The method of claim 14, wherein the print head assembly comprises a third actuatable biasing element having a distal end portion disposed between the distal end portions of the first and second actuatable biasing elements, the distal end portion of the actuatable biasing element coupled to a middle portion of the wiper, and wherein said applying varying forces comprises applying a varying force to the middle portion of the wiper via the third actuatable biasing element.

19. The method of claim 14, wherein said moving the print head assembly and said applying varying forces to the wiper are controlled by a programmable computer processor that is operable to execute a computer program containing instructions for an actuation sequence.

20. The method of claim 14, further comprising accessing and executing, with a programmable computer processor, a computer program containing instructions for an actuation sequence to actuate, in a programmed sequence, one or more of (i) the first and second actuatable biasing elements, (ii) a lifting actuator coupled to the substrate fixture, (iii) an ink emitter coupled to the print head assembly, and (iv) a pivot actuator coupled to the screen support frame.

* * * * *